US007356884B2

(12) United States Patent
Packard et al.

(10) Patent No.: US 7,356,884 B2
(45) Date of Patent: Apr. 15, 2008

(54) FASTENER FOR A DISPLAY PAGE

(75) Inventors: Joy A. Packard, Somerset, WI (US); Gerald E. Mueller, Eagan, MN (US); Scott D. Pearson, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 385 days.

(21) Appl. No.: 11/011,739

(22) Filed: Dec. 14, 2004

(65) Prior Publication Data

US 2005/0151038 A1 Jul. 14, 2005

Related U.S. Application Data

(60) Provisional application No. 60/530,592, filed on Dec. 18, 2003.

(51) Int. Cl.

| | |
|---|---|
| ***B65D 67/02*** | (2006.01) |
| ***G09F 3/08*** | (2006.01) |
| ***G09F 3/03*** | (2006.01) |
| ***G09F 3/16*** | (2006.01) |
| ***G09F 3/14*** | (2006.01) |

(52) U.S. Cl. ..... 24/16 PB; 24/304; 248/205.3; 248/74.3

(58) Field of Classification Search ..... 174/40 CC
See application file for complete search history.

(56) References Cited

U.S. PATENT DOCUMENTS

| | | | | |
|---|---|---|---|---|
| 3,006,048 | A * | 10/1961 | Windish | 24/16 R |
| 3,471,109 | A * | 10/1969 | Meyer | 248/68.1 |
| 3,473,768 | A * | 10/1969 | Piasecki | 248/68.1 |
| 3,516,631 | A * | 6/1970 | Santucci | 248/71 |
| 3,542,321 | A | 11/1970 | Kahabka | |
| 3,637,177 | A * | 1/1972 | Santucci | 248/74.3 |
| 3,669,555 | A | 6/1972 | Holes et al. | |
| 3,691,140 | A | 9/1972 | Silver | |
| 3,857,731 | A | 12/1974 | Merrill, Jr. et al. | |
| 4,166,152 | A | 8/1979 | Baker et al. | |
| 4,379,538 | A | 4/1983 | Welles | |
| 4,389,754 | A * | 6/1983 | Sohma | 24/16 PB |
| 4,439,896 | A | 4/1984 | Matsui | |
| 4,495,318 | A | 1/1985 | Howard | |
| 4,525,416 | A * | 6/1985 | Hammerschmidt et al. | 428/220 |
| 4,576,664 | A * | 3/1986 | Delahunty | 156/71 |
| 4,623,102 | A * | 11/1986 | Hough, Jr. | 248/68.1 |
| 4,706,914 | A * | 11/1987 | Ground | 248/74.3 |
| 4,805,856 | A * | 2/1989 | Nicoli et al. | 248/74.3 |
| 5,045,569 | A | 9/1991 | Delgado | |
| 5,571,617 | A | 11/1996 | Cooprider et al. | |
| 5,911,392 | A * | 6/1999 | Greenslate | 248/74.3 |
| 6,186,451 | B1 * | 2/2001 | Benoit | 248/74.3 |

* cited by examiner

FOREIGN PATENT DOCUMENTS

GB 2 116 247 A 9/1993

*Primary Examiner*—Robert J. Sandy
(74) *Attorney, Agent, or Firm*—Trisha D. Adamson

(57) ABSTRACT

A device for securing an article to a substrate includes an elongated resilient strap having a first end and a second end. The first end of the strap terminates in a strap passage. The second end of the strap is extendable through the strap passage to provide locking engagement between the strap and the strap passage. When the strap is drawn through the strap passage, a loop is formed for supporting the article. The device also includes a base positioned between the first end and the second end of the strap. The base includes a surface adapted for fastening the base to the substrate.

19 Claims, 2 Drawing Sheets

FASTENER FOR A DISPLAY PAGE

CROSS-REFERENCE TO RELATED APPLICATION(S)

This application claims priority from U.S. patent application Ser. No. 60/530,592, filed Dec. 18, 2003, for SCRAPBOOK ARTICLES by Joy A. Packard, Scott D. Pearson, Gerald E. Mueller, and Gary A. Albrecht, which is herein incorporated by reference in its entirety.

BACKGROUND OF THE INVENTION

The present invention relates to fasteners. More particularly, the present invention relates to fasteners for use with display pages.

Most generally, display pages are used with a book, album, binder or other holder that allows a user to store, organize and preserve scrapbook articles such as photographs, newspaper clippings, decorative papers, certificates, medals and other mementoes and memorabilia.

A scrapbook is a collection of one or more pages (e.g., display pages or scrapbook pages), each of which usually contains at least one photograph, writing, decorative element, memorabilia or the like. Most often, pages in the scrapbook are grouped by a common theme, such as a family vacation, wherein photographs and page embellishments are creatively and aesthetically arranged to preserve memories (reflected in the photographs) and enhance preserving and sharing those memories with other persons. Often, a user making the scrapbook desires to create a family heirloom that will last for generations.

A user (or "scrapbooker") typically attaches articles to a scrapbook page using a variety of specialized tapes, glues and adhesives. This can be a very time consuming process while waiting for glues and adhesives to dry or cure sufficiently. For example, photographs and decorative papers are often attached with pressure sensitive adhesives or glue sticks. Non-cellulosic embellishment articles such as ribbon, raffia and wire are typically much more difficult to place and challenging to attach, and such methods as hot melt adhesives or vinyl acetate glues are used, although with limited success. Because these methods involve a direct adhesive or glue attachment between the embellishment articles and the scrapbook page, the scrapbooker is often concerned with long-term preservation of the articles due to deterioration caused by the adhesive or glue. It is often undesirable to have any contact (or a substantial risk of contact) between the adhesive or glue and the scrapbook and embellishment articles. Furthermore, it is often desirable to remove a memorabilia item, such as a medal, during sharing of the scrapbook, and then return it to the scrapbook page. The adhesive or glue methods generally do not accomplish this well.

Occasionally, a scrapbooker will utilize items such as brads and nail heads that are affixed to a scrapbook page by methods such as puncturing the scrapbook page and bending or deforming a portion of the fastener (typically deforming a portion of the fastener that protrudes through the scrapbook page), which secures them to the scrapbook page. This method is often undesirable because it requires tearing or perforation of the scrapbook page, which can, in turn, lead to damage of articles stored on the scrapbook page. In addition, this method can leave sharp points exposed, which can damage adjacent scrapbook pages (and the articles stored on those adjacent pages).

Items used to affix scrapbook and embellishment articles can have sharp points, corners and otherwise have non-smooth and non-rounded features. Because a typical scrapbook includes a number of display pages positioned adjacent each other like a book, contact between the non-smooth and non-rounded items and other objects can cause damage to, for example, adjacent display pages and display and embellishment articles affixed thereon.

Another problem faced by a scrapbooker is the time required to assemble, affix, arrange, decorate and organize a display page for a scrapbook. It is undesirable to spend considerable time gluing, knotting, wrapping and performing other attachment operations to secure display and embellishment articles on a display page. Such attachment operations can be undesirably complicated.

Therefore, there is a need for an improved way of securely, conveniently, quickly and creatively attaching items and elements of a scrapbook to the page that does not detract from the aesthetic appearance of the scrapbook article. It is also desired to enhance the ability to easily remove and return items to a scrapbook page. It is still further desired to provide a fastener that contributes to the preservation of items on a scrapbook page and the scrapbook itself.

Thus, the present invention relates to fasteners that provide an alternative means of securing articles on a display page in a scrapbook or in other locations.

BRIEF SUMMARY OF THE INVENTION

The present invention is a device for securing an article to a substrate. The device includes an elongated resilient strap having a first end and a second end. The first end of the strap terminates in a strap passage. The second end of the strap is extendable through the strap passage to provide locking engagement between the strap and the strap passage. When the strap is inserted through the strap passage, a loop is formed for supporting the article. The device also includes a base positioned between the first end and the second end of the strap. The base includes a surface adapted for fastening the base to the substrate.

In one embodiment, the strap includes a plurality of lateral serrate ridges and the strap passage includes a pawl. This produces ratchet engagement between the strap and the strap passage when the second end of the strap is inserted through the strap passage. In addition, the strap passage may include a release member to facilitate release of the strap from locking engagement with the strap passage.

While the above-identified drawing figures set forth one embodiment of the invention, other embodiments are also contemplated, as noted in the discussion. In all cases, this disclosure presents the invention by way of representation and not limitation. It should be understood that numerous other modifications and embodiments can be devised by those skilled in the art which fall within the scope and spirit of the principals of this invention. The figures may not be drawn to scale. Like reference numbers have been used throughout the figures to denote like parts.

DETAILED DESCRIPTION

Figure 1A:
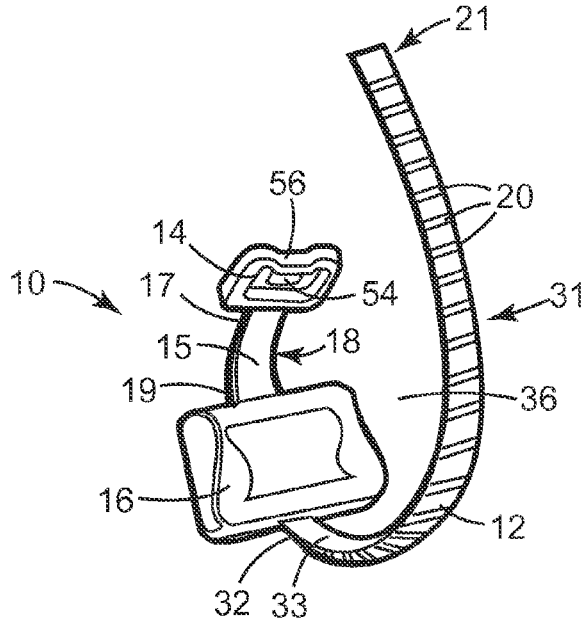
FIG. 1A is a perspective view of a fastener for securing articles on a display page according to an embodiment of the present invention.
Figure 1B:
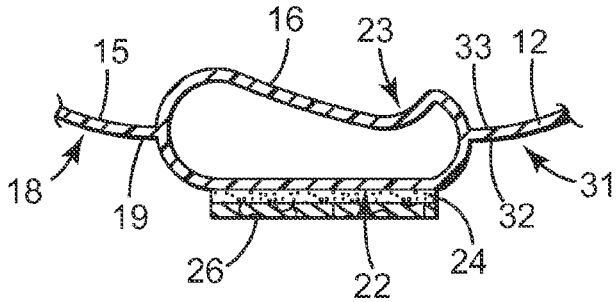
FIG. 1B is a sectional view of a base portion of the fastener shown in FIG. 1A.

FIG. 1A is a perspective view of fastener 10 for securing articles on a display page according to an embodiment of the present invention. Fastener 10 includes strap 12, strap passage 14, and base 16. Strap passage 14 is coupled to base 16 by mounting neck 18. Lateral serrate ridges 20 are formed on one or both sides of strap 12, and extend toward free end 21 of strap 12. FIG. 1B is a sectional view of a portion of fastener 10 including base 16. Base 16 includes surface 22 having a layer of adhesive material 24. Release liner 26 is removably provided on adhesive material 24.

Fastener 10 is used to secure an article to a substrate, such as a display page in a scrapbook or album. The article to be secured to the display page is attached to fastener 10 by extending free end 21 of strap 12 around a portion of the article and then subsequently drawing free end 21 of strap 12 through strap passage 14 to mechanically support the article. For example, free end 21 of strap 12 may be drawn through an aperture in the article and subsequently extended through strap passage 14 to support the article. This prevents the article from moving relative to fastener 10.

Strap 12, strap passage 14, base 16, and mounting neck 18 are preferably made of a flexible material that is pliable to facilitate attachment of fastener 10 to the article, but resilient and durable to endure handling and transporting of the substrate to which fastener 10 and the article held thereby are attached. In one embodiment, strap 12, strap passage 14, base 16, and mounting neck 18 are made a polymeric material, such as nylon, polyurethane, polyethylene, polypropylene, a polyester, a polyamide, an ionomer, or the like. The polymeric material may be transparent such that fastener 10 does not obscure any portion of the article held thereby (or the substrate to which fastener 10 is mounted). Alternatively, the polymeric material may be a colored or non-colored translucent or opaque material for ornamental purposes. Polymeric materials that are not appropriate for use in fastener 10 are those that include plasticizers, such as polyvinyl chloride, which may cause the integrity of fastener 10 to degrade over time and deleteriously affect the substrate or the article.

In one embodiment, strap 12, strap passage 14, base 16, and mounting neck 18 are formed integrally with each other. Fastener 10 is formed such that, when in a relaxed state as seen in FIG. 1A, strap 12 is spaced from strap passage 14. In one embodiment, fastener 10 is generally planar in a relaxed state (FIG. 1A illustrates an embodiment of fastener 10 wherein strap 12 and mounting neck 18 are curvilinear in a relaxed state). Strap passage 14 is shaped such that free end 21 of strap 12 is passable through strap passage 14. When strap 12 is passed through strap passage 14, strap 12 and strap passage 14 bend and become mechanically engaged with each other. This assures that the article held by fastener 10 remains secured to fastener 10 and to the substrate to which it is attached. In one embodiment, strap 12 and strap passage 14 comprise a cable tie and include a plurality of lateral serrate edges 20 that mechanically engage a pawl 54 formed on strap passage 14.

Base 16 is formed integrally with strap 12 and mounting neck 18. Base 16 provides the support for mounting the article held by fastener 10 to a display page. Particularly, base 16 includes surface 22 that is adapted for fastening to the substrate. As will be described in more detail herein, base 16 has a shape that includes cavity 23 that provides a seating location for the portion of the article held by fastener 10. However, it should be noted that base 16 may have any size or shape that is capable of providing support for the article and includes a surface adapted for securing the article to a substrate. For example, base 16 may have an ornamental shape to enhance the decorativeness of the article and the substrate to which fastener 10 is mounted.

Figure 2:
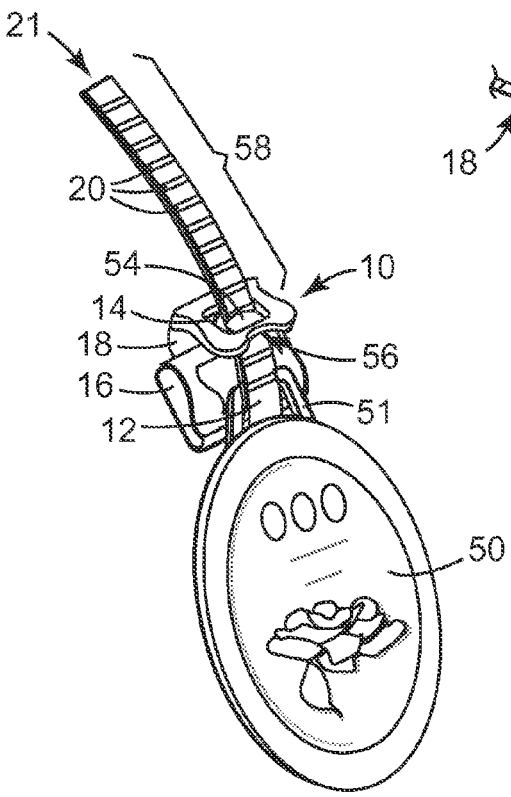
FIG. 2 is a perspective view of a fastener according to the present invention with an article to be secured to a display page attached thereto.

FIGS. 1A and 1B show the fastener 10 comprising: an elongated resilient strap 12 having a first strap portion which is the mounting neck 18 and a second strap portion 31, the first strap portion 18 having a first free end 17 terminating in a strap passage 14, and a first proximal end 19, the second strap portion 31 having a second free end 21 and a second proximal end 32, where the second free end 21 of the strap 12 is extendable through the strap passage 14 to provide mechanical engagement between the second strap portion 31 of the strap 12 and the strap passage 14 and thereby fastening the first strap portion 18 to the second strap portion 31 and forming a loop (as shown in FIG. 2 for supporting the article 50, the loop provides an article securing space 36 defined between a first inner surface 15 on the first strap portion 18 and a second inner surface 33 on the second strap portion 31, where the first inner surface 15 and the second inner surface 33 face each other. A base 16 is positioned between the first proximal end 19 of the first strap portion 18 and the second proximal end 32 of the second strap portion 31, the base 16 including a surface 22 adapted for fastening the base 16 to the substrate and a support surface having a concave portion forming a resilient concave cavity 23 (as shown in FIG. 1B) opposite the surface 22 adapted for fastening the base 16 to a substrate, such as a display page. The concave portion of the support surface being spaced radially inward from the first inner surface 15 and the second inner surface 33 and toward the article securing space 36.

In one embodiment, surface 22 of base 16 includes a layer of adhesive material 24 to allow fastener 10, and the article supported thereby, to be mounted and displayed on any number of substrates, including albums and scrapbooks. Surface 22 is generally planar to provide a platform for adhesive material 24. Adhesive material 24 may be provided on a portion of surface 22 or may completely coat surface 22. Adhesive material 24 may be an acid-free, photograph-safe adhesive to prevent chemical damage to the substrate and any photographs that may be mounted near fastener 10. Adhesive material 24 may also be a repositionable adhesive, which permits fastener 10 to be adhered to and removed from a substrate multiple times without significant loss of adhesive capability. In one embodiment, the repositionable adhesive is a repositionable microsphere pressure sensitive adhesive, for example as described in U.S. Pat. Nos. 5,571,617, 5,045,569, 4,495,318, 4,166,152, 3,857,731, and 3,691,140. Additionally, adhesive material 24 may be a permanent adhesive.

In one embodiment, release liner 26 is provided on adhesive material 24 to prevent fastener 10 from becoming adhered to a surface before desired. When a user wishes to secure fastener 10 on a substrate, release liner 26 is peeled away from surface 22 to expose adhesive material 24. When adhesive material 24 is exposed, fastener 10 may be mounted on a desired substrate. In one embodiment, release liner 26 is a sheet of paper coated with a release coating on its side facing adhesive material 24. The release coating may be of any known materials used for their release properties for adhesives. Exemplary materials of this type are silicones and modified silicones, the modification including both copolymerization of silicones with other non-release chemical agents or by adding non-silicone materials to the silicone coating solution prior to application to the base paper of the release liner. Other release agents such as polyethylene, fluorocarbons, and polyvinyl octadecyl carbamate may also be used. The choice of release coating is dependent on the tack, adhesion level, and chemical nature of adhesive material 24.

FIG. 2 is a perspective view of a fastener 10 according to the present invention with article 50 attached thereto. Article 50 is a medallion or other such award having eyelet 51 thereon. Article 50 is attached to fastener 10 by passing free end 21 of strap 12 through eyelet 51. Strap 12 is then passed through eyelet 51 until eyelet 51 rests on base 16 in or proximate to cavity 23. Subsequently, free end 21 of strap 12 is extendable through strap passage 14 so as to provide a loop for supporting article 50 formed by strap 12, strap passage 14, and base 16. Strap 12 is drawn or cinched up into strap passage 14, which causes flexible strap 12 and mounting neck 18 to bend toward each other over base 16, as seen in FIG. 2. Strap 12 and mounting neck 18 are now in a flexed state, which aids in urging strap passage 14 against strap 12.

Pawl 54 is a resilient projection that extends from an internal side of strap passage 14. As strap 12 is drawn through strap passage 14, pawl 54 is deflected by passage of ridges 20 on strap 12. Ridges 20 and pawl 54 provide ratchet engagement between strap 12 and strap passage 14 such that withdrawal of strap 12 from strap passage 14 is effectively prevented as pawl 54 engages with ridges 20. In one embodiment, the ratchet engagement produced between strap 12 and strap passage 14 by ridges 20 and pawl 54 is substantially similar to that shown and described in U.S. Pat. No. 3,542,321, entitled "Tie" by R. Kahabka, which is herein incorporated by reference. Additionally, a release member attached to pawl 54 may optionally be provided to provide means for raising pawl 54 sufficiently to clear ridges 20 when withdrawal of strap 12 from strap passage 14 is desired (for example, to remove article 50 from fastener 10). Also, it should be noted that while ridges 20 and pawl 54 are produce mechanical engagement between strap 12 and strap passage 14, any means for engaging strap 12 and strap passage 14 to provide a loop for holding an article may alternatively be employed.

Strap 12 is inserted through strap passage 14 until strap 12, strap passage 14, base 16, and mounting neck 18 form a loop of desired size to hold article 50. Strap 12 may be optionally drawn through strap passage 14 until strap passage 14 is adjacent to base 16 and article 50 (i.e., cinched within strap passage 14 as tightly as possible). This causes eyelet 51 of article 50 to be held between strap 12, strap passage 14, and base 16. This secures article 50 relative to fastener 10 such that movement between fastener 10 and article 50 is minimized. Notch 56 is formed in strap passage 14 to provide relief and a seat for strap 12 when strap passage 14 is drawn adjacent to base 16. When strap 12 has been inserted through strap passage 14 to the desired position, excess strap portion 58 (which extends from strap passage 14 and includes free end 21 of strap 12) may optionally be removed (such as by cutting with a scissors) to reduce the overall size of fastener 10.

Figure 3:
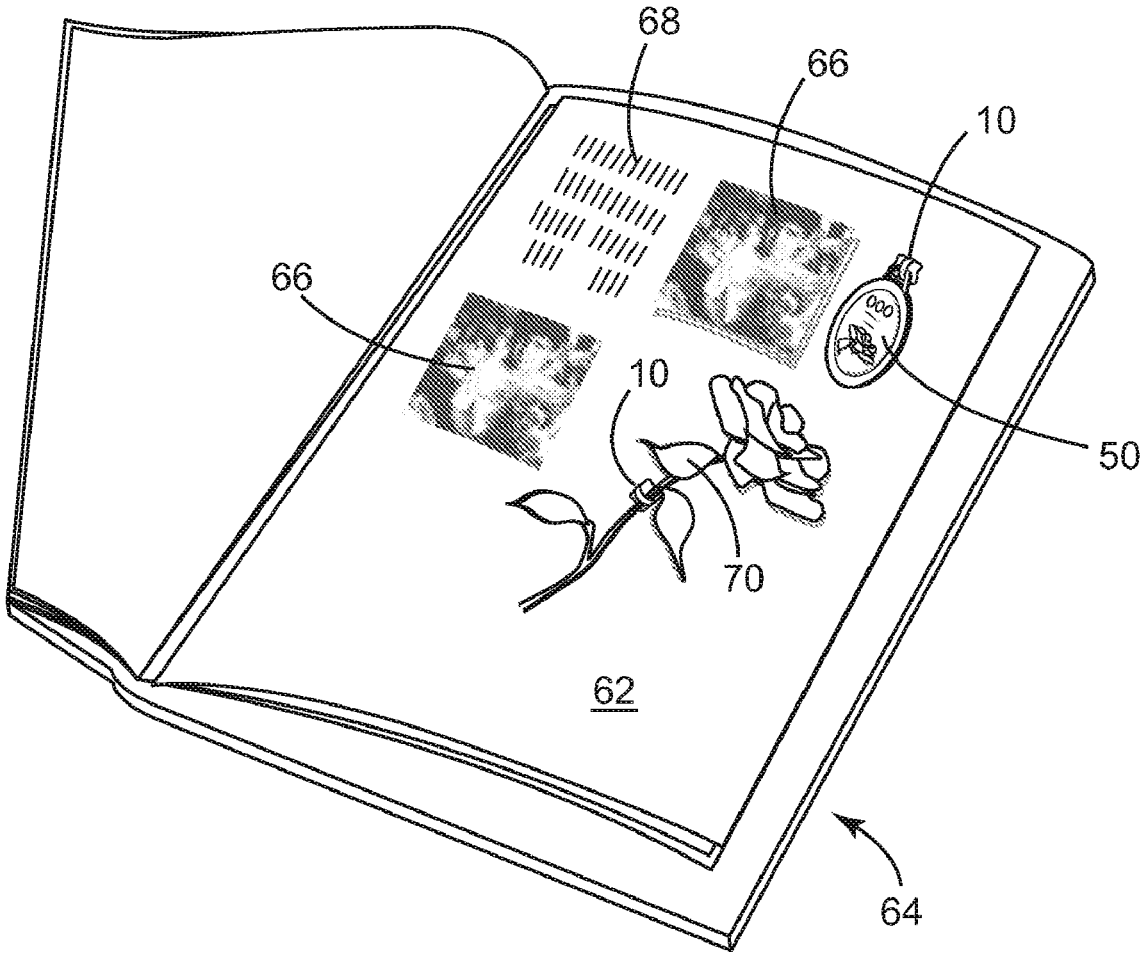
FIG. 3 is a perspective view of a display page including articles secured thereto by fasteners according to the present invention.

FIG. 3 is a perspective view of article 50 attached to fastener 10 according to the present invention and secured to display page 62. Display page 62 is a page in scrapbook or album 64. When article 50 has been attached to fastener 10, a user subsequently prepares fastener 10 for securing to display page 62. In the embodiment of fastener 10 shown in FIGS. 1A and 1B, release liner 26 is first peeled from surface 22 to expose adhesive material 24. When adhesive material 24 is exposed, fastener 10 may be secured to display page 62. Fastener 10 is arranged and oriented on display page 62 as necessary to provide the desired positioning of article 50 relative to other articles on the page (e.g., photographs 66, text 68, etc.). Pressure is then applied to base 16 of fastener 10 to secure fastener 10 (and article 50 attached thereto) to display page 62. When mounted on display page 56, fastener 10 preferably has a minimal elevation relative to display page 56. In one embodiment, fastener 10 protrudes from display page 56 by less than 0.375 inch (0.953 cm).

Article 50 includes eyelet 51 to facilitate securing article 50 relative to fastener 10. If the article to be secured to display page 62 does not include an aperture through which to insert strap 12 (or if the fabricating an aperture in the article would damage the article), the article may alternatively be secured to fastener 10 by cinching strap 12 tightly against a portion of the article. For example, flower 70 is shown secured to fastener 10 in FIG. 3. Fastener 10 is attached to flower 70 such that the stem of flower 70 is held between strap 12, strap passage 14, and base 16. When flower 70 is secured to display page 62, flower 70 is held relative to fastener 10 by simple surface friction between fastener 10 and flower 70. Additional fasteners 10 may also be attached along the stem of flower 70 to provide additional stability and more securing points to display page 62.

Fastener 10 of the present invention provides several advantages over the prior art. For example, unlike prior attachment methods that require direct contact between adhesive and the article to be secured to the substrate, no adhesive is provided on strap 12, strap passage 14, mounting neck 18, or the top surface of base 16 (i.e., those element that come in contact with article 50 or flower 70). This prevents potentially deleterious contact between an adhesive material and article 50, flower 70, or other articles on adjacent pages in scrapbook 64. Additionally, fastener 10 is compliant and resilient, has rounded edges and corners, and smooth surfaces in order to minimize possible damage to article 50, flower 70, and the underlying display page 62. Also, when provided with a repositionable adhesive fastener 10 may be readily detached and reattached to various substrates, allowing article 50 and flower 70 to be moved to various locations until placed in the desired position. In addition, when a release member is coupled to pawl 54, article 50 and flower 70 are readily removable from fastener 10, thereby allowing use in another application without fastener 10 or allowing attachment of a different article to fastener 10. Furthermore, two-sided memorabilia are mountable with fastener 10 such that both sides of the memorabilia can be easily viewed by pivoting the memorabilia on fastener 10.

Various modifications to fastener 10 and uses therefor that have been described may be made without departing from the spirit and scope of the present invention. For example, while article 50 and flower 70 are shown attached to display page 62 by fasteners 10 in FIG. 3, it will be appreciated that a myriad of other articles may be secured to display page 62 using fasteners 10 according to the present invention. Other articles that may be attached using fasteners 10 include, but are not limited to, fabrics, plastics, ribbons, charms, medals, and certificates. Furthermore, fastener 10 has been described with regard to adhesive material 24 on surface 22, but any material or mechanism may be used to provide a means for attaching fastener 10 to a substrate. Examples of alternative means for attaching fastener 10 to a substrate include surface fasteners such as hook and loop system fasteners, magnetic devices such as a magnetic strip or a magnetic backing, or other adhesive materials such as double-sided tape. Also, adhesive may be provided on the substrate to which the fastener is secured in addition to or instead of adhesive material 24 on surface 22.

In summary, conventional items used to affix scrapbook and embellishment articles can have sharp points, corners and otherwise have non-smooth and non-rounded features. In addition, it is undesirable to spend considerable time gluing, knotting, wrapping and performing other attachment operations to secure display and embellishment articles on a display page. Furthermore, it is undesirable to have any contact (or a substantial risk of contact) between adhesive or glue on the securing device and the scrapbook and embellishment articles. The present invention is a fastener that addresses these and other issues by providing an alternative means of securing articles on a display page in a scrapbook or in other locations. The fastener includes an elongated resilient strap having a first end and a second end. The first end of the strap constitutes a mounting neck and terminates in a strap passage. The second end of the strap is extendable through the strap passage to provide locking engagement between the strap and the strap passage. When the strap is drawn through the strap passage, a loop is formed for supporting the article. The device also includes a base positioned between the first end and the second end of the strap. The base includes a surface adapted for fastening to the substrate. The fastener is compliant and resilient, has rounded edges and corners, and smooth surfaces in order to minimize possible damage to the article and the underlying (or facing) display page.

Although the present invention has been described with reference to preferred embodiments, workers skilled in the art will recognize that changes may be made in form and detail without departing from the spirit and scope of the invention.

The invention claimed is:

1. A device for securing an article to a substrate, the device comprising:

an elongated resilient strap having a first strap portion and a second strap portion, the first strap portion having a first free end and a first proximal end, the second strap portion having a second free end and a second proximal end, the first free end terminating in a strap passage, wherein the second free end of the strap is extendable through the strap passage to provide mechanical engagement between the strap and the strap passage and thereby fastening the first strap portion to the second strap portion and forming a loop for supporting the article, the loop providing an article securing space defined between a first inner surface on the first strap portion and a second inner surface on the second strap portion, where the first inner surface and the second inner surface face each other; and a base positioned between the first proximal end of the first strap portion and the second proximal end of the second strap portion, the base including a surface adapted for fastening the base to the substrate and a support surface having a concave portion forming a resilient concave cavity opposite the surface adapted for fastening the base to the substrate, the concave portion of the support surface being spaced radially inward from the first inner surface and the second inner surface and toward the article securing space.

2. The device of claim 1, wherein the strap includes a plurality of lateral serrate ridges and the strap passage includes a pawl to produce ratchet engagement between the strap and the strap passage.

3. The device of claim 1, wherein the second end of the strap is insertable through an aperture in the article prior to engaging the strap and the strap passage to provide support for the article.

4. The device of claim 1, wherein at least a portion of the surface adapted for fastening the base to the substrate includes a layer of adhesive material.

5. The device of claim 4, wherein the adhesive material is an acid-free adhesive.

6. The device of claim 4, wherein the adhesive material is a repositionable pressure sensitive adhesive.

7. The device of claim 4, wherein the adhesive material is a permanent adhesive.

8. The device of claim 4, and further comprising:

a release liner removably provided on the adhesive material.

9. The device of claim 1, wherein the device comprises a polymeric material.

10. The device of claim 9, wherein the polymeric material is transparent.

11. A fastener for securing an article to a display page, the fastener comprising:

an elongated resilient flat strap having a first strap portion and a second strap portion, the first strap portion having a first free end, a first proximal end and a first inner surface, and the second strap portion having a second free end, a second proximal end, a second inner surface, and a second outer surface;

a strap passage coupled to the first free end of the elongated strap, the strap passage including a resilient pawl extending from an inside edge of the strap passage;

a plurality of lateral serrate ridges on the second outer surface of the second strap portion for mechanically engaging with the pawl, wherein the second free end of the second strap portion is extendable around a portion of the article and through the strap passage to hold the portion of the article in a securing space to hold the article relative to the fastener; and a base formed integral with the strap between the strap passage and the lateral serrate ridges, the base including a surface adapted for fastening the base to the display page and a support surface having a concave portion forming a resilient concave cavity opposite the surface adapted for fastening the base to the display page, whereby the support surface abuts the article;

the concave portion of the support surface being spaced radially inward from the first inner surface and the second inner surface and toward the securing space.

12. The fastener of claim 11, wherein the second end of the strap is insertable through an aperture in the article to provide support for the article.

13. The fastener of claim 12, wherein at least a portion of the surface adapted for fastening the base to the display page includes a layer of adhesive material.

14. The fastener of claim 13, wherein the adhesive material is an acid-free adhesive.

15. The fastener of claim 13, wherein the adhesive material is a repositionable pressure sensitive adhesive.

16. The fastener of claim 13, wherein the adhesive material is a permanent adhesive.

17. The fastener of claim 13, and further comprising:

a release liner removably provided on the adhesive material.

18. The fastener of claim 11, wherein the fastener comprises a polymeric material.

19. The fastener of claim 18, wherein the polymeric material is transparent.

* * * * *